US005845979A

United States Patent [19]

Longhurst et al.

[11] Patent Number: 5,845,979

[45] Date of Patent: Dec. 8, 1998

[54] SUSPENDABLE STORAGE UNIT

[75] Inventors: Robert E. Longhurst, R.F.D Box 351, Potterbrook Farm, Chestertown, N.Y. 12817; Fredric T. Morelle, Schenectady, N.Y.

[73] Assignee: Robert E. Longhurst, Chestertown, N.Y.

[21] Appl. No.: 876,563

[22] Filed: Jun. 16, 1997

Related U.S. Application Data

[63] Continuation-in-part of Ser. No. 560,481, Nov. 17, 1995, Pat. No. 5,649,751.

[51] Int. Cl.[6] ..... A47F 5/08

[52] U.S. Cl. ..... 312/246; 248/222.51; 52/39; 312/326

[58] Field of Search ..... 312/245, 248, 312/325, 326, 327, 246; 248/222.51, 311.2; 52/27, 39

[56] References Cited

U.S. PATENT DOCUMENTS

| | | | |
|---|---|---|---|
| 4,446,660 | 5/1984 | Miller et al. | 52/36 |
| 4,699,437 | 10/1987 | Genereaux | 312/248 |
| 5,104,079 | 4/1992 | Hardtke | 52/39 X |
| 5,242,219 | 9/1993 | Tomaka | 312/245 |
| 5,628,153 | 5/1997 | Fontanez | 52/39 |
| 5,649,751 | 7/1997 | Longhurst | 312/245 X |

*Primary Examiner*—Peter M. Cuomo
*Assistant Examiner*—Stephen Vu
*Attorney, Agent, or Firm*—Fredric T. Morelle

[57] ABSTRACT

A structual support-or joist-suspendable storage case. An open-top box unit is suspended for pivotal motion and fixation between rafters, joists, etc. The suspension and movement mechanism includes hooks and, optionally, detents (or studs). In the preferred embodiment, only identical hooks are used in braces or pair-assemblies, one of each pair mounted to a side of the box unit, and its complement fixed to a structural element in a position best suited to receive the box-mounted device. Two or more of the assemblies are featured per unit. Alternatively, the assemblies may consist of a hook and studded hook combination where either hook or studded hook is placed on the box and its complement is fixed to a structural element.

4 Claims, 4 Drawing Sheets

SUSPENDABLE STORAGE UNIT

RELATED DOCUMENTS

This application is a continuation-in-part of U.S. application Ser. No. 08/560,481, filed on Nov. 17, 1995, now U.S. Pat. No. 5,649,751.

BACKGROUND OF THE INVENTION

1. Field of the Invention

This invention relates generally to storage containers and, in particular, to a suspendable storage unit that is pivotally mounted to a pair of support members and which can be moved into a nested storage between the members. The salient feature of the invention is employment of pairs of identical hook elements which physically complement each other by mutually fulfilling the roles of coupling, suspending, pivoting, and sliding.

2. Discussion of the Relevant Art

Many articles have been devised that will, or do, fulfill the above stated attributes; but, none seem to exist that possess the simplicity, yet high degree of utility, embodied in our present storage unit. Insofar as nestability between support members is concerned, U.S. Pat. No. 4,699,437 ('437) issued to Genereaux, shows elements that achieve the aforementioned attributes. The salient elements are the container, projections from the container to which are mounted wheels, thus imputing a pivotal character, and opposing hook (ends) wheel receivers that are mounted on the supports and which impute suspendable and securable (in nested stowage) facilities to the patented article. This patent has been eclipsed, we feel, by U.S. Patent No. [allowed application Ser. No. 08/560,481, filed Nov. 17, 1995], issued to Longhurst. The Longhurst patent achieves the aforementioned attributes through the use of un-wheeled projections: in a first embodiment, consisting of a singular rod and, in a second, consisting of a hook element. We have now improved on the Longhurst invention by the use of paired devices/elements that take on not only a similar character to the Longhurst invention but are, in and of themselves, identical to each other. Thus, the instant invention transcends the prior relevent art by eliminating moving parts and greatly simplifying the elements or apparatus necessary to construct it. Further, the simplification is evident by virture of the fact that, in the preferred embodiment, the suspension, pivotation and securement elements are identical. From a standpoint of manufacturing efficiency, this factor lends a degree of utility that is clearly novel.

3. Incorporation by Reference

The aforementioned patents, U.S. Pat. No. 4,699,437 and U.S. No. [application Ser. No. 08/560,481] show features similar to those of the instant invention in their pivotal function and in the use of curvate or arcuate members that act as receptors. Also, the nestability or stowability character is common to all three. For these reasons, and with respect to similar functions and features, those patents, and particularly all of the Longhurst drawings, are hereinafter incorporated by reference.

4. Definitions

To facilitate an understanding of the invention, we have used a multiplicity of terms that are generically defined:

a. complement(ary) (n.,adj.) that which completes a whole or unit, such as a single hook of a hook-pair or the remainder of a combination that has been parted;

b. coupling (n.,v.) is a connection or connecting, either fixed or movable and is mechanized by (fixed) bolting, welding or (movable) linking, knuckling;

c. panels as used herein, are box or case sides;

d. pivotal (adj.) means supporting angular movement or moment;

e. stop (v.) is to halt action or (n.) is a device, element or feature which effects a stopping of some action such as pivoting or sliding;

f. stud (n.) is one of many synonyms for a projection such as a detent or a rod.

SUMMARY OF THE INVENTION

Shortcomings and limitations of the prior art have been cured by this invention. In the preferred embodiment, multiplicity of funtional coupling/connecting elements has been abandoned in favor of a single coupling mechanism consisting of a pair or brace of hook elements, preferredly identical, whereby realization in the manufacture thereof is greatly simplified. In its most basic mode, the invention uses a pair of hooks situated apart from one another on edges, sides or panels of a box-like container. Another pair of identical hooks is situated each hook on a joist or support member that is adjacent and parallel to another. The joist-mounted hooks are disposed planarly on their respective joist or perpendicular thereto. The container-disposed hooks are then fitted in knuckle-coupled fashion (planar mounting) to the joist-disposed pair or in a hook-over-projection (linking or girdling) fashion thereto. Either knuckle coupling or a linking/girdling coupling retains the pivotal feature first disclosed in U.S. Patent No. [allowed U.S. Ser. No. 08/560,481] issued to Longhurst.

An alternate embodiment employs not two, but four pairs of hooks in either the knuckle coupling or linking/girdling coupling modalities. Further, these modalities can be mixed, provided the container width is close to that of the joist spacings. Anytime the container width does not nearly approximate the joist spacing, the link/girdle-coupling mode must be used or, if manufacturing allows, detents or projections from either containers, container-disposed hooks or the joist-disposed hooks are entertained. Without a doubt, this invention, with its hook-hook pivotal coupling mechanism is a useful and practical advancement in storage container art. Any modifications or variations are performed only on/or to the hooks of the invention for purposes of pivoting, suspending, etc. of the storage unit. The hooks are bent to define either arcuate or angled portions, or both. They are mounted closely adjacent and planar to joist or container surfaces, or are perpendicular thereto. Or, in lieu of perpendicular mounting, they sustain detents or projections perpendicular to the hook's plane. These detent or projections simply provide a complementary engagement feature for a hook so that the combination will operate in the linking/girdling-coupled mode. The invention, in all of its embodiments and modalities is inculcated hereinafter by use of the drawings. It should be understood, however, that not all possible variations of hook structure can be touched upon; and thus, only the most practical are presented.

DETAILED DESCRIPTION OF THE PREFERRED EMBODIMENT

As one may readily infer, there is but a singular invention presented herein, but one having a very high degree of application that is afforded by the use of similar, if not identical, hook(ed) devices. The hooks (as such devices will be referred to generically) are in the form of a J and need not employ only arcuate geometry. The alternate embodiment provides a hook of the preferred shape including, but projecting perpendicularly from its plane, a detent in the form of a short dowel, stud or rod. Such will be seen in FIGS. 10–14 and should be viewed as a hook adjunct to be used in lieu of postioning either hook (of a hook-pair) perpendicular to the other in order to acquire a linking/girdling relationship. This latter modality is preferred only when over-spacing between joists/supports dictates it.

Figure 1:
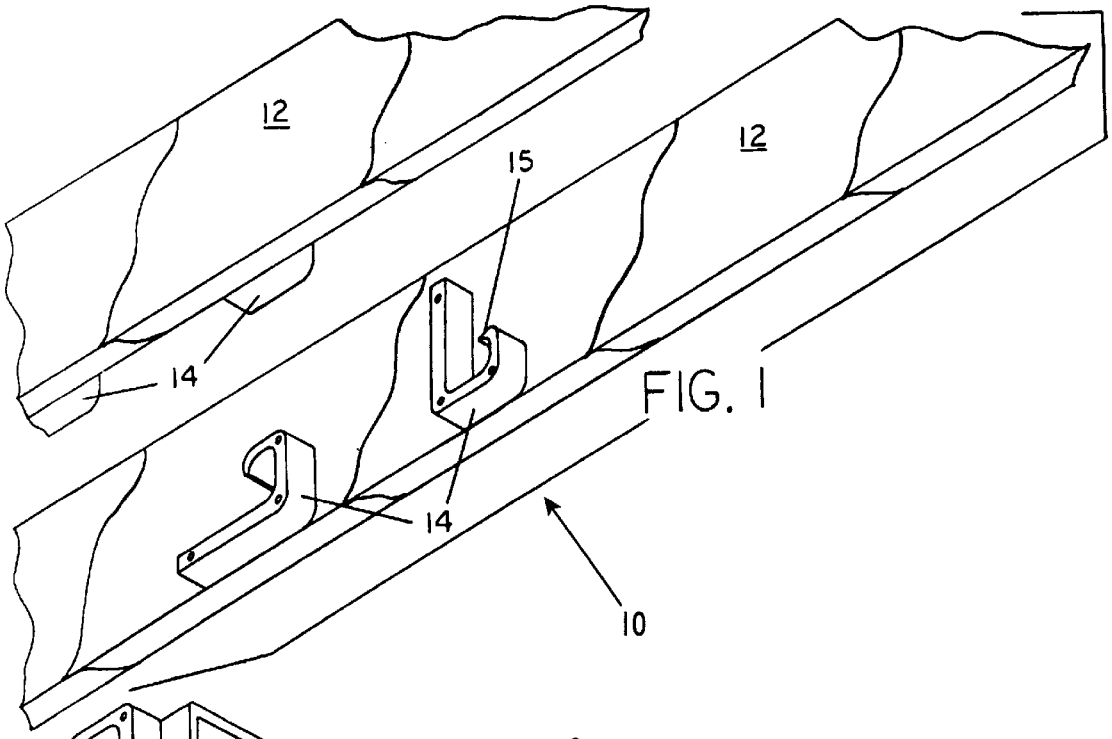
FIG. 1 is an illustration of hook disposition in a joist/support network.
Figure 2:
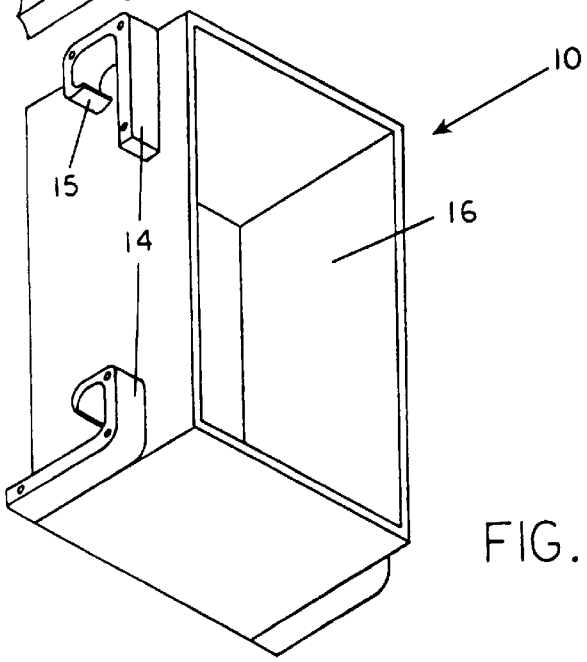
FIG. 2 is a typical container equipped and in position for suspension by knuckle-coupling.

Referring particularly to FIG. 1, there is shown a pair of parallel rafters or joist (structural support members) 12 bearing thereon and therebetween four discrete hooks 14 of the invention 10. Each hook 14 has the shape of a J and may possess an arcuate or angular geometry. The reflexed portion 15 is the most critical, it effecting not only the principal engagement mechanism (coupling in knuckle or link modes), but limiting the pivoting/rotational or angular moment, lest the container 16 break free from suspension. The top of the J shape is variable, from a simple elogation to a broadened head, in a geometry that has a substantially larger area to accept therein a peg or short rod, or have such formed in (i.e., integrally with) the hook. Such a variation is termed a projection or a detent and is addressed specifically in the discussion of FIGS. 10–14.

Figure 3:
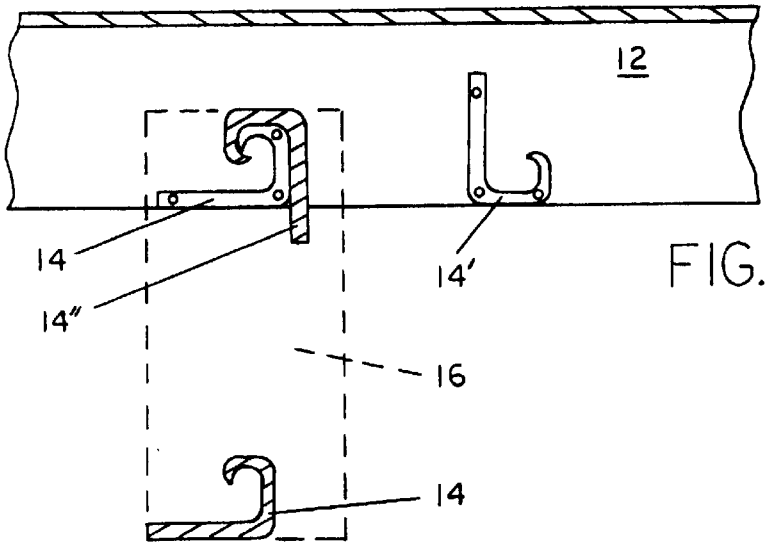
FIGS. 3, 4 and 5 illustrate, in elevational view, container suspension, pivotal movement and a securing engagement, by use of the invention, with respect to a single support member.
Figure 4:
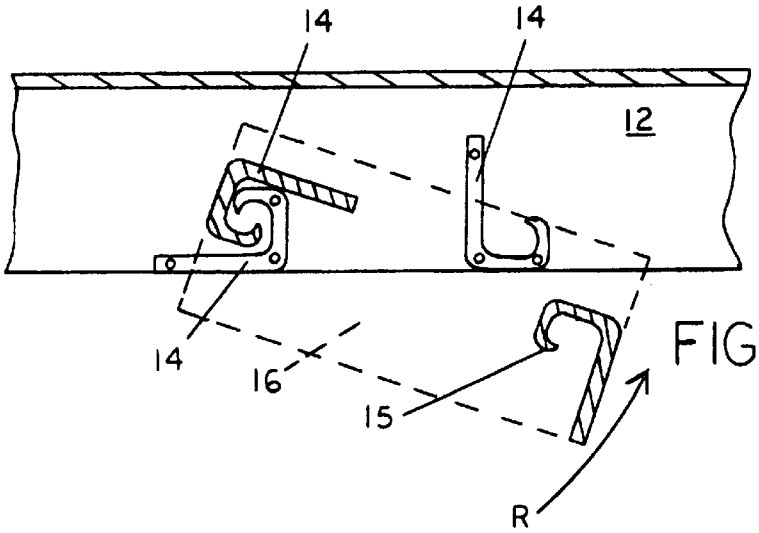
Figure 5:
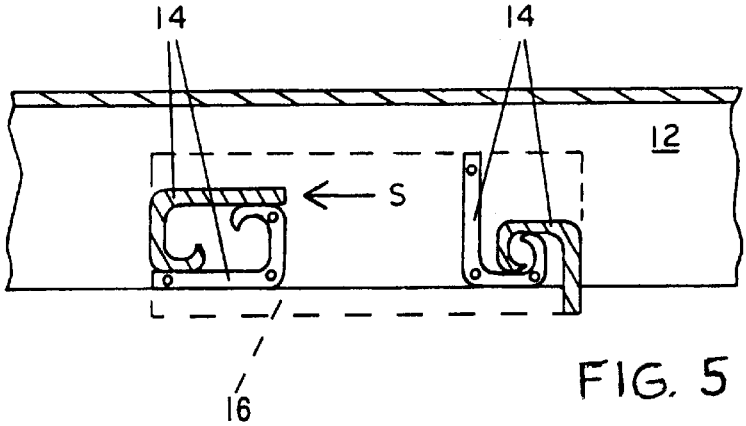

The illustrations of FIGS. 3–5 provide one (of many) layouts of hooks on containers 16 and support members 12. Specifically, FIG. 3 shows a container profile in dashed lines with cross-sections of container-mounted hooks disposed thereon. The complements of the container hooks are mounted to the support members so as to receive the containers hooks in the knuckle-coupled mode. FIG. 3 shows the initial suspension while FIGS. 4 and 5 show the container rotation R and nested stowage securement, respectively. In FIGS. 3 through 5, only the hooks 14 disposed on one support member and one side of the container 16 are shown for the sake of clarity. Further, only one of many possible positions for hooks on the container are shown. Referring to FIG. 3, the container end hooks (here, side mounted) are slipped over their complements (of the hook-pair) that are disposed on joist 12 of a typical building structure. FIG. 4 shows rotation R of the container 16 as coupled hooks of FIG. 3 are pivoted, or rotated, with respect to each other; and, FIG. 5 shows the final sliding motion S that is used to secure the container-hook assembly. It should be noted that all the hooks of FIGS. 1 through 5 are very similar, but not necessarily identical. With different placement of the hooks on the container and the joists, it is possible and reasonable to use identical hooks, both such as hook 14' (disposed on the joist, at the extreme right and poised as the numeral 6); while both hooks on the container 16 would be disposed as is the upper hook 14" of the figure, that is, resembling the numeral 9.

Figure 6:
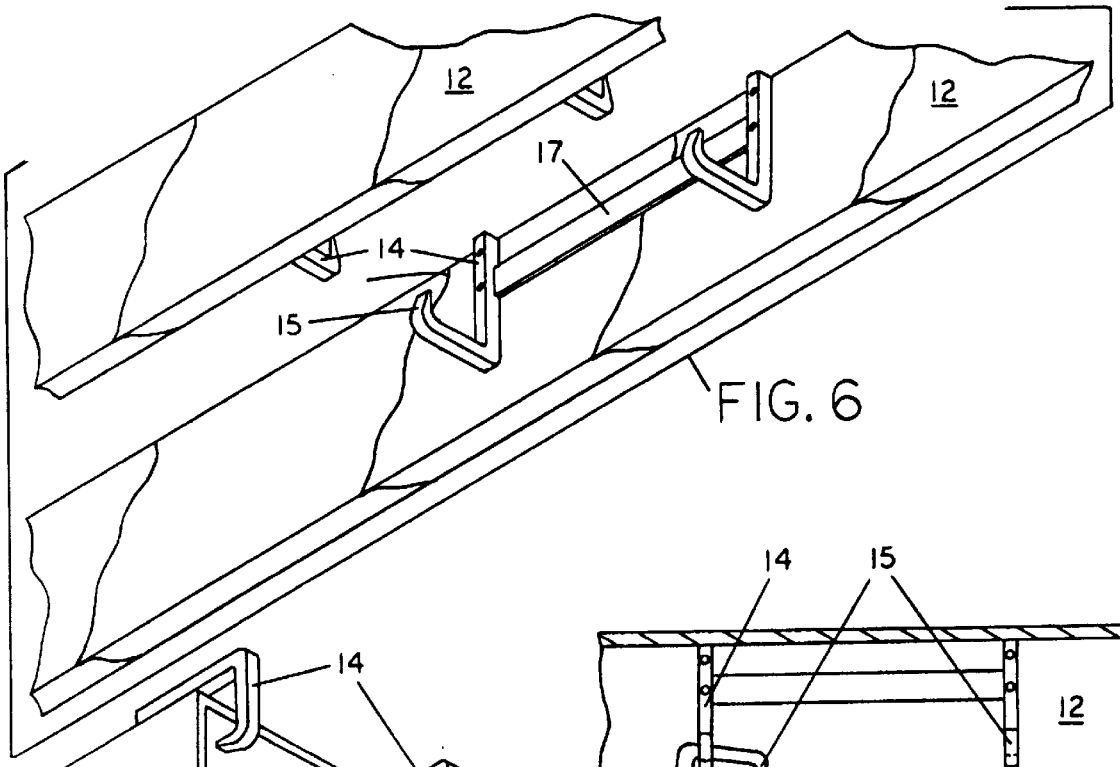
FIGS. 6 and 7 are, respectively, FIGS. 1- and 2- type views of a link or girdle coupling.
Figure 7:
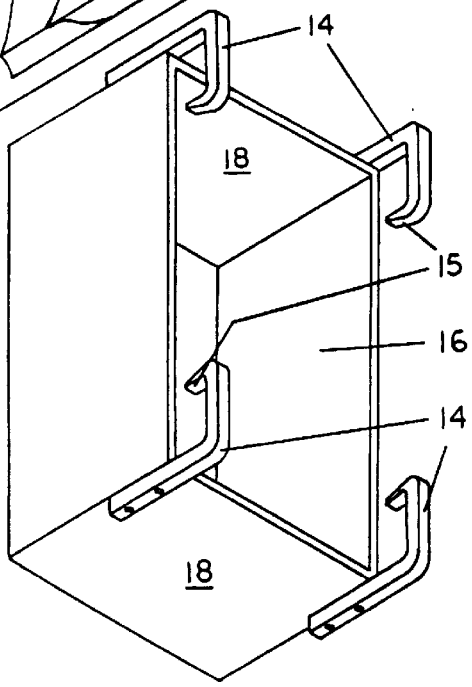
Figure 8:
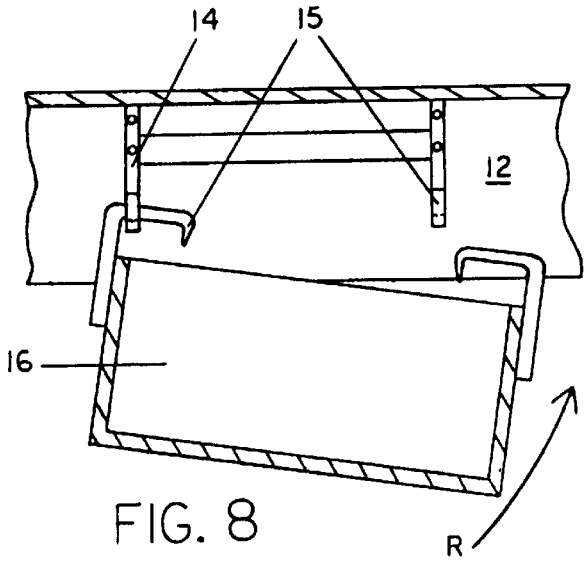
FIGS. 8 and 9 are, respectively, FIGS. 4- and 5- type views of the link coupling.
Figure 9:
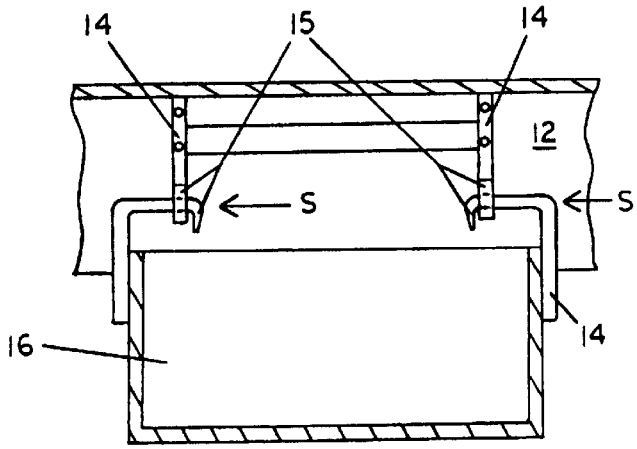
Figure 10:
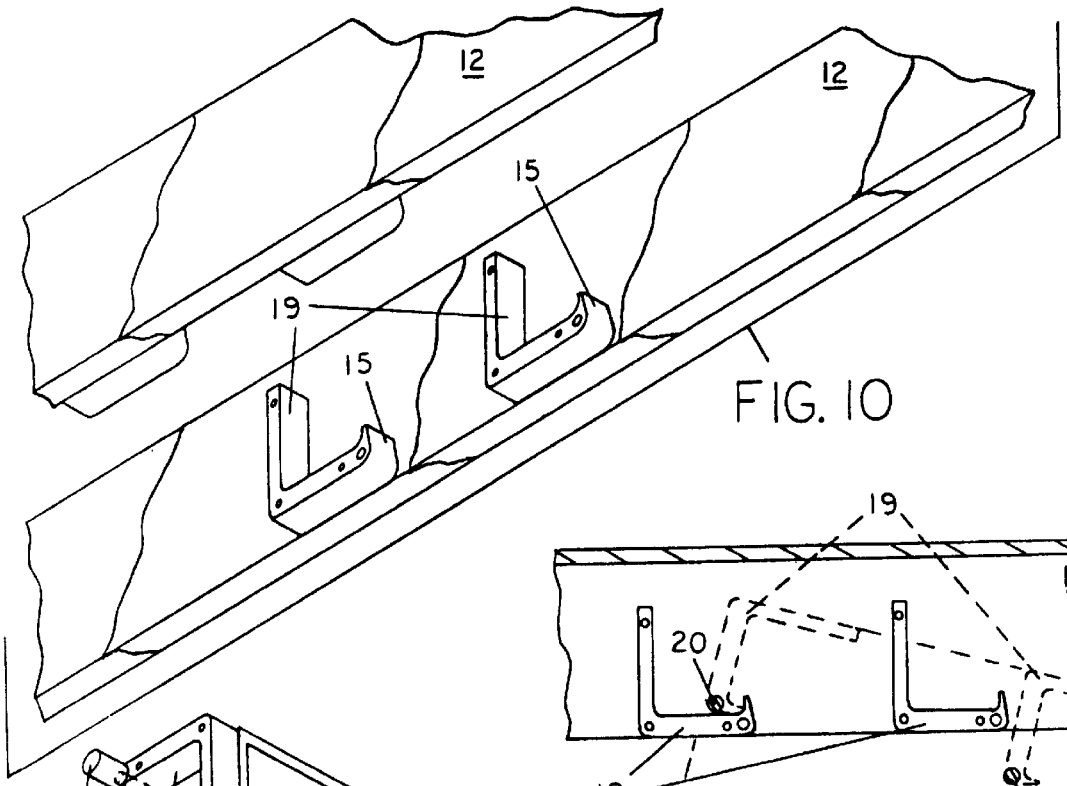
FIGS. 10 and 11 are similar to the preferred FIGS. 1 and 2 but show use of an alternate form of hook mechanism for use in an over-spaced joist/support situation.
Figure 12:
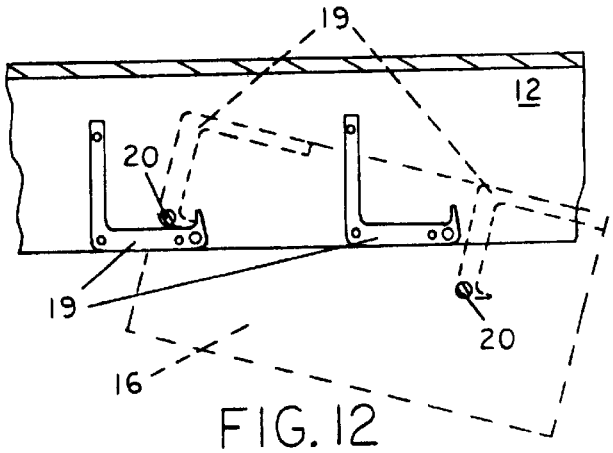
FIGS. 12 and 13 are analogous views of FIGS. 4 and 5 using the alternate hook of FIGS. 11–13.
Figure 11:
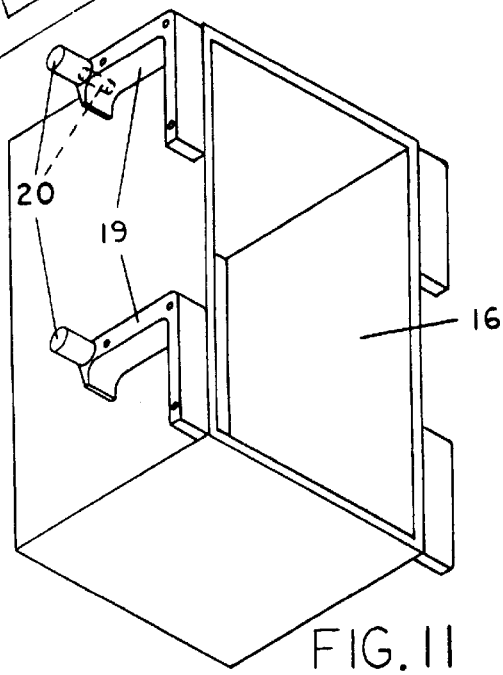
Figure 13:
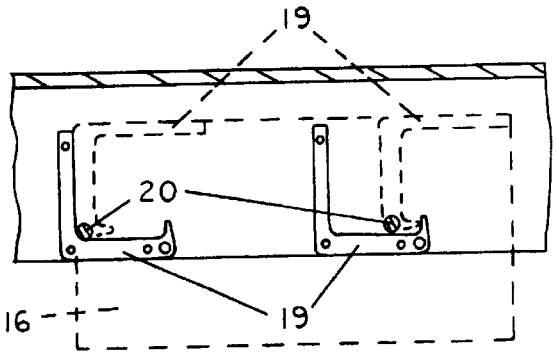

To acquire coupling in the link mode, a different mounting of identical hooks is used. FIGS. 6–9 illustrate this modality which is quite useful when faced with unconventional joist spacings or undersized (widthwise) containers. In FIG. 6, slightly different shaped hooks 14 are mounted to joist 12, but oriented so that the lower J portion projects essentially perpendicularly from the joist. An adjunct, in the form of a spacer 17, is also employed to expedite and position the perpendicular disposition of the hooks. In FIG. 7 the hooks are positioned on the ends 18 of the container 16 and are both shaped identically and placed in the same orientation with respect to a container end 18, that is, facing inwardly of the box. This hook array is especially useful for the reasons given above and has an added safety advantage as shown in FIGS. 8 and 9. For example, the assembly of this modality is readily suspended and rotated R in the direction shown. However, should it fall backward, i,e., counter-rotate, the reflexed ends 15 of the hooks prevent disengagement by the container, especially should it translate excessively towards one of the joists. FIG. 9 shows how this same hook detail will prevent disengagement by a suspended container through sliding S while in the stowed posture. The final set of drawings, FIGS. 10 through 14 depict the invention with hooks set in the first modality, parallel planar mounted, but functionable in both modalities, i.e., adaptable for knuckle-or-link-coupling or both, in a hybrid mode. Specifically, FIG. 10 illustrates the preferred embodiment on the joist 12 in that identical hooks are placed in the upright J posture. The left hook 19 is modified to accept, i.e. receive, a supplemental piece. Referring to FIG. 11, the container 16 is shown bearing at least two types of modified hooks 19 which may or may not contain pegs/detents/studs 20. Further, the studs 20 may be various sizes (lengths) in order to span safely the spacings between container and joist. FIGS. 12–13 present another form of hybrid assembly which uses four joist hooks, at least two modified hooks 19 with studs 20 and two without studs. Such an assembly is shown here in order to demonstrate the invention's versatility along with its simplicity; the inventors generally use all hooks 14 or 19/20 in the two non-hybrid modalities.

Figure 14:
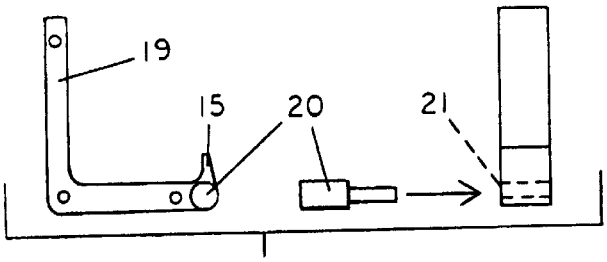
FIG. 14 is an orthographic drawing of the alternate hook form.

Relative to hooks 19, FIG. 14 clearly defines their character: FIG. 14 depicts, in orthographic views, the modified hook 19 including the press-fitted stud 20 (or detent). In the side elevation, the through-hole 21 is seen receptive of a variable length stud or rod 20. Once inserted the stud/rod 20 defines a detent on the hook 19. It may be press-fitted into the hole 21 or molded integrally with the hook. Further, if integrally or unitarily formed, the shank of the hook may be of the same physical definition as hook 14, a wider shaft not being needed.

Methodology

We have shown, albeit in not every conceivable posture, how a coupling/connecting assembly consisting in a brace or matched pair of hook members may be used to connect a portion of a container to a fixed structure so that the container may be pivotally secured thereto. Irrespective of whether two (pair or) braces of the invention or four are employed, the application remains consistent: one element (a single hook) is set to a container panel in the desired orientation and its complement (remaining assembly) is disposed on the structure. The orientation of the complement is selected to accomplish the design of pivoting and stopping, as previously discussed. By working with the invention, many more innovative applications of the invention can be had; as well as more devices, such as detents, stops, etc. might be added to enhance a particular function. Such are deemed to be beyond the scope of the invention and would probably distrupt its elegant simplicity.

Having presented our invention in its preferred form with suggested variations, it is now commended to the field. Many other variations of hook shapes, orientations and modifications such as addition of studs, pivots and the like will become apparent with time and usage. Such should be employed consistent with the spirit of the invention and within the ambit of the hereinafter appended claims.

What is claimed is:

1. An open storage unit comprising a box having a bottom side parallel to an open side surrounded by a top panel, two parallel side panels, and a bottom panel, wherein each of said side panels has two rigid, single-piece J-shaped hooks projecting from the side panels and adapted to engage with complementary J-shaped hooks on two parallel structural supports, each of said hooks defines an elongated flange perpendicular to a bottom flange having a reflexed portion for engagement with a corresponding reflexed portion on the complementary hooks in order to prevent the hooks from disengaging from the complementary hooks when said unit is adapted to be pivotally moveable and securable in nested storage between the two parallel structural supports.

2. An open-top storage container having four J-shaped hooks for effectively mountable, pivotally movable and securable in nested storage between two structural supports, said container comprising:

a box having a bottom side parallel to an open side surrounded by a top panel, two parallel side panels, and a bottom panel, wherein each of said side panels has said two rigid, single-piece J-shaped hooks projecting from the side panels and adapted to engage with complementary J-shaped hooks on two parallel structural supports, each of said hooks defines an elongated flange perpendicular to a bottom flange having a reflexed portion adapted to engage with a corresponding reflexed portion on the complementary hooks in order to prevent the hooks from disengaging from the complementary hooks when said unit is adapted to be pivotally moveable and securable in nested storage between the two parallel structural supports.

3. The container of claim 2 wherein at least two of the hooks are adapted to project a stud therefrom.

4. The container of claim 2 wherein at least two of the hooks comprise a stud means that projects perpendicularly from a lateral surface thereof.

* * * * *